United States Patent [19]

Parker

[11] 4,074,380

[45] Feb. 21, 1978

[54] RECOVERY BUOY

[76] Inventor: David H. Parker, 336 Via Pasqual, Redondo Beach, Calif. 90277

[21] Appl. No.: 763,871

[22] Filed: Jan. 31, 1977

[51] Int. Cl.[2] ..... B63B 21/52; B63B 51/02

[52] U.S. Cl. ..... 9/8 R; 9/9; 114/16.5

[58] Field of Search ..... 9/8 R, 8.3 R, 8.3 E, 9/9; 114/16.5

[56] References Cited

U.S. PATENT DOCUMENTS

| | | | |
|---|---|---|---|
| 1,993,974 | 3/1935 | McVicker | 9/8 R |
| 3,037,217 | 6/1962 | Mandra | 9/8.3 R |
| 3,374,494 | 3/1968 | Hunley | 9/9 |
| 3,553,751 | 1/1971 | Lewis | 9/9 |
| 3,618,150 | 11/1971 | Anselmi | 9/8.3 E |
| 3,626,528 | 12/1971 | Jackson | 9/9 |

*Primary Examiner*—Trygve M. Blix
*Assistant Examiner*—D. W. Keen
*Attorney, Agent, or Firm*—Matthew P. Lynch

[57] ABSTRACT

A recovery buoy which is carried underwater by a diver and comprises an indented spool-like body of lightweight material around which is wrapped a cord. A weight is detachably mounted to the body and is attached to the cord so that the weight end of the cord can be attached to a structure to be recovered or marked, and when the body is released, its buoyancy causes it to rise, thereby unspooling the cord.

20 Claims, 2 Drawing Figures

RECOVERY BUOY

BACKGROUND

1. Field of the Invention

This invention is directed to a recovery or marker buoy which can be handled underwater by divers, have its line attached to a structure to be recovered, and have the body float to the surface for marking and recovering.

2. The Prior Art

In both sport and professional "diving," it is often helpful or necessary to mark a location or attach a line to a structure to be recovered. It thus becomes desirable for a diver to be able to carry with him a recovery buoy which is easy to handle and convenient to carry. This includes the requirement that the buoy has a structure which provides equilibrium to counteract or neutralize hydrostatic pressure exerted on the buoy while in submerged condition, enabling the diver to move and navigate through the water with a minimum of resistance. Furthermore, the buoy should be easily carried and must be easily operable to minimize the underwater time to accomplish a given task.

The prior art structures have been ungainly because they are of difficult size or shape to carry or do not include appropriate attachment devices. They have been difficult to use because in some of them the weight release is difficult to manage. Others are expensive so that they are less likely to be routinely carried along on a dive. For these reasons, an improved recovery buoy is required.

SUMMARY

In order to aid in the understanding of this invention, it can be stated in essentially summary form that it is directed to a portable recovery buoy. The recovery buoy has a body which is indented for the winding of a line therearound. The body is made of low density synthetic material. A weight is detachably mounted on the buoy body to offset buoyancy thereof while under water. A line is permanently attached at its one end to the body, wrapped around the indented portion, and at its free end is attached to the weight.

It is thus an object of this invention to provide a recovery buoy assembly which is convenient to use, inexpensive and reliable. It is a further object to provide a recovery buoy assembly which has a body of low density synthetic material and which, to counteract normal hydrostatic pressure encountered at sub-water level, is counterbalanced by a detachable weight to prevent premature buoyancy. It is a further object to provide a recovery buoy having a line which is attached with one end to the body of the buoy and with the other end to the counterbalance weight so that the recovery buoy can be easily and conveniently used.

Other objects and advantages of this invention will become apparent from a study of the following portion of the specification, as well as the claims and the drawings.

DESCRIPTION

Figure 1:
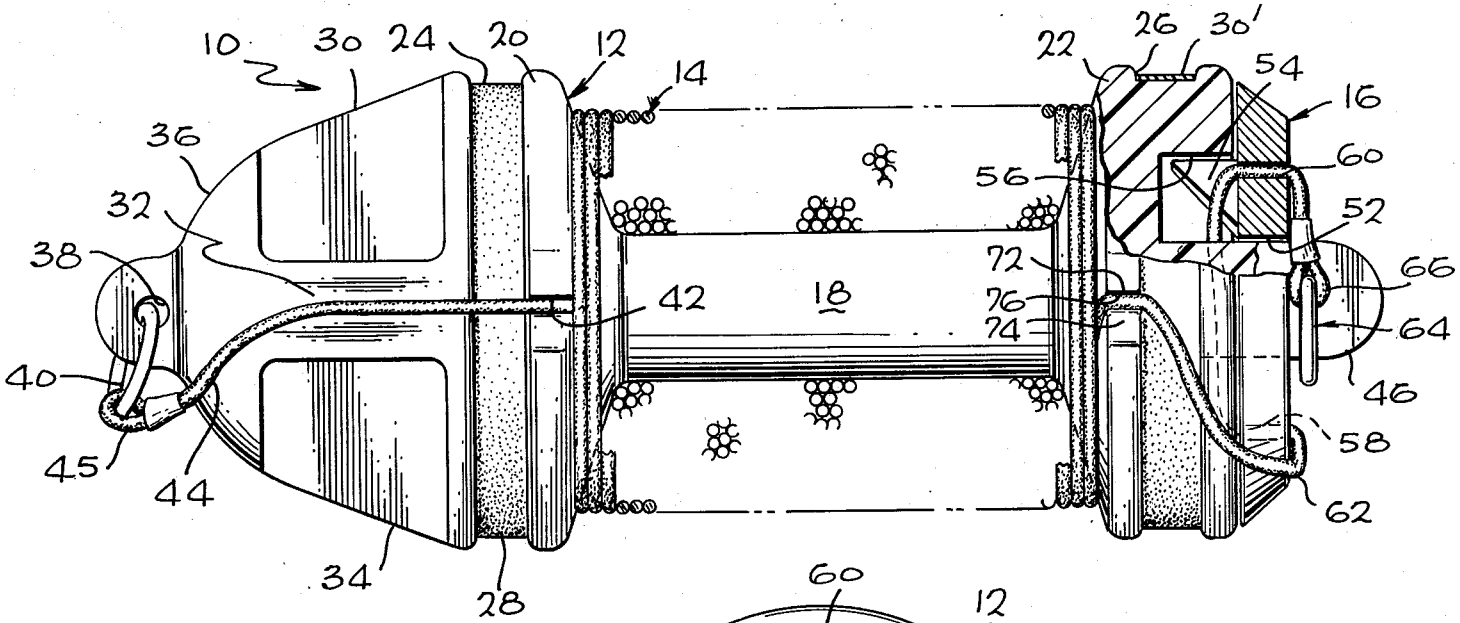
FIG. 1 is a side-elevational view of the recovery buoy of this invention showing the line wound thereon partly broken away and taken in section.
Figure 2:
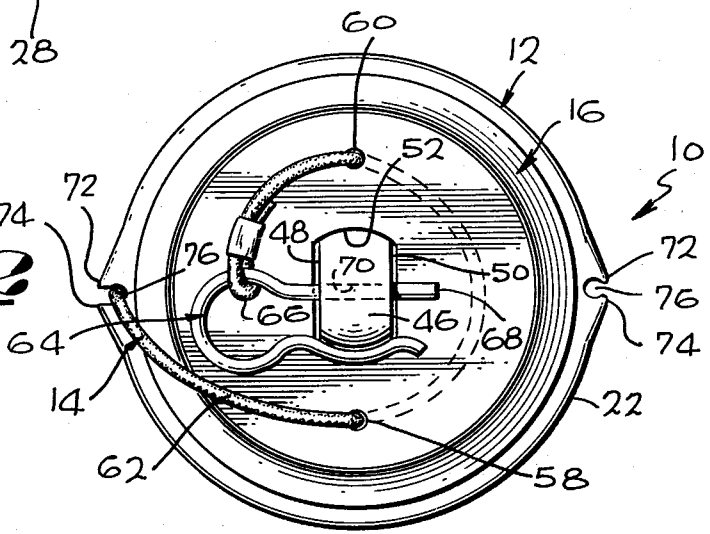
FIG. 2 is a right-end elevational view of the structure shown in FIG. 1.

The recovery buoy assembly of this invention is generally indicated at 10 in both FIGS. 1 and 2. The assembly 10 comprises a body 12, line 14, and weight 16. Body 12 is thermoplastically molded from a synthetic polymer composition material which has a lower density than water. It is preferably foamed polyethylene with an integral skin which provides a smooth surface. Such structure is lightweight, of inexpensive manufacture, and is sturdy and tough for a long service life. It may be of a bright color, such as orange, to maximize visibility. Body 12 is generally spool-shaped with an axial central spindle 18 concentric with the longitudinal axis of the body and disposed between opposed facing flanges 20 and 22. Central spindle 18 has a cylindrical exterior surface, while flanges 20 and 22 are provided with internal, generally axial frusto-conical surfaces with the central angle of the cone extending at approximating 150 degrees. This shape aids in both deployment and in winding of the line. As is seen in FIG. 1, line 14 is wound on central spindle 18 in-between the flanges 20 and 22. A recess 24 on flange 20 and recess 26 on flange 22 contain markers 28, 30 of high reflectivity. Such marker strips are commercially available as, for instance, "Scotch Light," (T.M. of the 3M Company, of St. Paul, Minnesota) and are conveniently applied using the pressure-sensitive adhesive on the inner side thereof. These markers 28 and 30 aid in finding the recovery buoy by vision.

Four panels are provided on the left end of flange 20. Three of these panels are seen at 30, 32, and 34, and the other is located behind the buoy, as is seen in FIG. 1, opposite panel 32. These panels provide flat surfaces which reflect light to further aid in the finding of the buoy.

Head 36 terminates in ring opening 38 which receives ring 40. Flange 20 has molded therein a guide notch 42 so that the end 44 of line 14 which is first wound on central spindle 18, lies in notch 42 and is secured by loop 45 to ring 40.

A stud 46 extends outward from flange 22 on the longitudinal axis of the body. Stud 46 is non-circular in configuration and has opposed flat sides 48 and 50 as seen in FIG. 2. Weight 16 is generally circular in shape and has an outer circumferential diameter slightly smaller than that of flange 22. Weight 16 has a central opening 52 which fits over stud 46. Weight 16 has a plurality of projecting fingers, one of which is shown at 54 in FIG. 1. The fingers 54 extend into annular recess 56 which extends into the end of the body, interiorly of flange 22 and around stud 46. Fingers 54 are angular and sharp-pointed. Holes 58 and 60 extend through weight 60 between the fingers 54. The outer end 62 of the line 14, extends down through hole 58 and up through hole 60. End 62 of the line 14 is attached to a securing clip 64 by means of a loop 66. Securing clip 64 has a straight shank 68 which extends into a crosshole 70, which is positioned through stud 46 outwardly from weight 16. When securing clip 64 is in place, it holds the weight 16 on the stud 46 and thus retains it in position on the body 12. Both clip 64 and weight 16 are thus secured on the outer end 62 of line 14.

In order to maintain the line 14 tightly wound between the flanges, the outer end 62 of the line is engaged between ears 72 and 74 formed in the outer periphery of flange 22. The ears 72 and 74 form a notch 76 between them into which the line 14 can be pressed and detachably retained.

In operation, when the diver takes the recovery buoy 10 with him, it is in the condition described. The weight 16 is selected to be of such a size and of such mass as to offset and counteract buoyancy. As previously described, body 12 of the recovery buoy is buoyant, as can be the material of which line 14 is made. For example, polypropylene is a satisfactory line material, and as such is buoyant in water. The diver attaches the recovery buoy to his belt by means of ring 40 and then dives. By reason of its so-called state of equilibrium while submerged, the assembly 10 enables the diver to freely move and maneuver in and through the water. It should be noted that at this point and on account of the counter forces involved, i.e., the upwardly directed tendency of the buoy body due to hydrostatic pressure exerted thereon and the downwardly directed, neutralizing or opposing force provided by the weight 16, the buoy assembly is in a state of substantial weightlessness. Such underwater state of equilibrium of the assembly is achieved by carefully and properly selecting the exact quantity of buoyant material both for the buoy body and line, on the one hand, and the mass and density of the counterbalance weight, on the other hand.

When the diver arrives at the submerged equipment or object to be recovered, he detaches the recovery buoy 10 from his belt. He then pulls securing clip 64 from its engagement with stud 46 so that the outer end 62 of the line is freed as weight 16 comes off of stud 46. He pulls the outer end of the line from notch 76 and unwinds a few turns from the body. This amount of line he employs to be secured to the object to be recovered. At any time after the weight is released from the stud and the outer end 62 of the line is released from notch 76, the diver can release the body of the recovery buoy assembly. The buoyant body will rise, unspooling line behind it. The diver need only secure the weight to the object. In cases where a spot is to be marked rather than an object to be recovered, weight 16 is engaged on the sea floor, either by its own weight or by being pressed into the sea floor. For this purpose, the fingers 54 aid in anchoring the weight. In either case, the body floats, and the line is unspooled. The diver's companions on the surface can see the recovery buoy, and when an object is to be recovered, they can hoist it up by the line. When the buoy is used as a marker, its presence can mark the appropriate spot.

The invention having been described in its preferred embodiment, it will be clear that it is susceptible to numerous modifications and embodiments within the ability of those skilled in the art and without the exercise of inventive faculty. Accordingly, the scope of this invention is defined by the scope of the following claims.

What is claimed is:

1. A recovery and marker buoy, comprising:

an enlongated body of buoyant material having axially opposite ends;

a first flange member at one of said ends;

a second flange member at the second one of said ends;

a cylindrical central spindle intermediate said first and second flange members, said flange members including opposed frusto-conical surfaces interconnecting said flange members with said spindle;

a location indicating head formed integrally with said first flange member on the axis of said body;

a weight associated with said second flange member on the axis of said body;

clamp means for detachably mounting said weight on said second flange member and being coupled to said weight;

a line wound around said central spindle and having a first end, and a second end, said second end extending through said weight, in looped fashion, and being secured to said clamp means to securely retain said weight on the line second end upon detachment of said clamp means from said second flange member and dislodgement of said weight therefrom; and means for securing said first end of said line to said location indicating head and means for detachably mounting said weight to said second flange, whereby upon release of said weight from said second flange member and said body, anchoring of said weight at a selected location beneath water level may be effected and said line unreels from said central spindle under the buoyant force of said body, enabling the latter to freely float to the surface of the water, in which condition said location indicating head, upon surfacing, is operable to mark a location.

2. The recovery and marker buoy of claim 1, further comprising means on said second flange member for tightly releasably retaining the wound line in position on said central spindle, the retaining member being embedded within the peripheral surface of said second flange member and preventing axial movement of said line second end relative to said central spindle.

3. The recovery and marker buoy of claim 2, wherein said retaining member on said second flange member is formed by a pair of ears defining a retaining notch therebetween, said notch clampingly engaging said line second end and operable to release said line second end upon disengagement of said weight from said second flange member.

4. The recovery and marker buoy of claim 1, further comprising marker strips disposed about said first and second flange members, in peripheral relation with the exterior surfaces thereof.

5. The recovery and marker buoy of claim 1, further comprising marker means on said first and second flange.

6. The recovery and marker buoy of claim 5, wherein said marker strips are disposed in recesses formed in the outer circumference of said first and second flange members.

7. The recovery and marker buoy of claim 1, wherein said means for securing said first end of said line to said location indicating head comprises a ring movably positioned in a passage formed in said head and being movably secured to said first end of said line.

8. The recovery and marker buoy of claim 7, wherein said first end terminates into a looped portion secured to said ring.

9. The recovery and marker buoy of claim 1, wherein said second end of said line terminates into a looped portion secured to said clamp means.

10. The recovery and marker buoy of claim 9 wherein said clamp means comprises a pair of unobstructed passages in said weight for the guidance of said second end therethrough, said passages having a diameter dimensioned such as to retain said looped portion in position on the outer face of said weight.

11. The recovery and marker buoy of claim 10, wherein said clamp means further comprises a stud member on the outer face of said second flange member, and comprising a clip member detachably secured on said stud member, said stud member extending through said weight, the latter being detachably retained on said stud member by said clip member.

12. The recovery and marker buoy of claim 11, wherein said stud member extends outwardly from said second flange, member on the axis of said body.

13. The recovery and marker buoy of claim 12, wherein said stud member comprises a cross hole and wherein said clip member is detachably positioned in said crosshole.

14. The recovery and marker buoy of claim 13, wherein said clip member is movably secured to said looped portion of said second line end, and wherein upon release of said clip member from said stud member, the former is retained on said weight.

15. The recovery and marker buoy of claim 14, wherein said weight has a circumference of a diameter approximating that of said second flange member.

16. The recovery and marker buoy of claim 1, wherein said buoyant material of said body is in the form of a foamed synthetic polymer composition material.

17. The recovery and marker buoy of claim 16, wherein said polymer composition material extends continuously over the entire buoy body.

18. The recovery and marker buoy of claim 1, further comprising anchoring members on said weight enabling the latter to be firmly secured to the sea floor, said anchoring members comprising a plurality of projecting fingers on one face of said weight detachably secured to said second flange member.

19. The recovery and marker buoy of claim 18 wherein said second flange member has an outer face and annular recess in said outer face and wherein, in assembled condition of the buoy, said anchoring members are accommodated in said recess.

20. The recovery and marker buoy of claim 19, wherein said anchoring members are pointed and of angular configuration.

* * * * *